US011149605B2

(12) United States Patent
Schleiermacher et al.

(10) Patent No.: US 11,149,605 B2
(45) Date of Patent: Oct. 19, 2021

(54) EXHAUST PIPE, COMBUSTION ENGINE MACHINE, AND MOTOR VEHICLE

(71) Applicant: VOLKSWAGEN AKTIENGESELLSCHAFT, Wolfsburg (DE)

(72) Inventors: Vitali Schleiermacher, Tappenbeck (DE); Ronny Krzok, Rethen (DE); Uwe Schrottke, Calberlah (DE); Dirk Thuermann, Lehre-Flechtorf (DE)

(73) Assignee: VOLKSWAGEN AKTIENGESELLSCHAFT, Wolfsburg (DE)

( * ) Notice: Subject to any disclaimer, the term of this patent is extended or adjusted under 35 U.S.C. 154(b) by 0 days.

(21) Appl. No.: 16/623,938

(22) PCT Filed: Jun. 5, 2018

(86) PCT No.: PCT/EP2018/064708
§ 371 (c)(1),
(2) Date: Dec. 18, 2019

(87) PCT Pub. No.: WO2018/234027
PCT Pub. Date: Dec. 27, 2018

(65) Prior Publication Data

US 2020/0173322 A1 Jun. 4, 2020

(30) Foreign Application Priority Data

Jun. 19, 2017 (DE) ..... 10 2017 113 357.7

(51) Int. Cl.
*F01N 3/023* (2006.01)
*F01N 3/05* (2006.01)
(Continued)

(52) U.S. Cl.
CPC ..... *F01N 3/023* (2013.01); *F01N 3/05* (2013.01); *F01N 3/2892* (2013.01); *F01N 3/34* (2013.01);
(Continued)

(58) Field of Classification Search
CPC ..... F01N 3/023; F01N 3/05; F01N 3/2892; F01N 3/34; F01N 13/009; F01N 13/08;
(Continued)

(56) References Cited

U.S. PATENT DOCUMENTS 2,293,632 A 8/1942 Urban
3,947,544 A 3/1976 Yamada et al.
(Continued)

FOREIGN PATENT DOCUMENTS

CN 102465733 A 5/2012
CN 102979603 A 3/2013
(Continued)

OTHER PUBLICATIONS

Search Report for German Patent Application No. 10 2017 113 357.7, dated Feb. 6, 2018.
(Continued)

*Primary Examiner* — Audrey B. Walter
(74) *Attorney, Agent, or Firm* — Pearl Cohen Zedek Latzer Baratz LLP

(57) ABSTRACT

An exhaust pipe for the exhaust tract of a combustion machine, which has an inlet opening for an air connection, is characterized by an inner pipe section which is surrounded by an outer pipe section in order to form an annular channel that is closed at one end and at the other end is open toward the inner volume of the exhaust pipe, wherein the inlet opening for the air connection opens into the outer pipe section. By means of such an exhaust pipe, advantageous mixing of air supplied via the air connection into the exhaust
(Continued)

gas flowing within the exhaust pipe can be achieved with a simple design, which can be attributed in particular to the complete introduction of the air in combination with the flow direction that is present along the longitudinal axis of the annular channel and the exhaust pipe.

11 Claims, 2 Drawing Sheets

(51) Int. Cl.

| | |
|---|---|
| ***F01N 3/28*** | (2006.01) |
| ***F01N 3/34*** | (2006.01) |
| ***F01N 13/08*** | (2010.01) |
| ***F01N 13/18*** | (2010.01) |
| ***F01N 13/14*** | (2010.01) |

(52) U.S. Cl.
CPC ..... *F01N 13/08* (2013.01); *F01N 13/143* (2013.01); *F01N 13/1805* (2013.01); *F01N 13/1838* (2013.01); *F01N 2240/20* (2013.01); *F01N 2470/08* (2013.01); *F01N 2470/24* (2013.01); *F01N 2610/08* (2013.01)

(58) Field of Classification Search
CPC ..... F01N 13/143; F01N 13/1805; F01N 13/1838; F01N 2240/20; F01N 2250/02; F01N 2270/04; F01N 2470/08; F01N 2470/24; F01N 2610/08
See application file for complete search history.

(56) References Cited

U.S. PATENT DOCUMENTS

| | | | | |
|---|---|---|---|---|
| 3,963,444 | A * | 6/1976 | Yamada | B01D 53/944 422/109 |
| 4,339,918 | A | 7/1982 | Michikawa | |
| 6,536,420 | B1 | 3/2003 | Cheng | |
| 6,837,213 | B1 | 1/2005 | Burnett | |
| 10,584,625 | B1 * | 3/2020 | Woods | F01N 13/08 |
| 2007/0119433 | A1 | 5/2007 | Popik et al. | |
| 2008/0098499 | A1 | 4/2008 | Oxborrow | |
| 2008/0127641 | A1 | 6/2008 | Kellermann | |
| 2012/0124995 | A1 | 5/2012 | Springer et al. | |
| 2014/0086804 | A1 | 3/2014 | Gruenwald et al. | |
| 2016/0084138 | A1 | 3/2016 | Ferguson | |
| 2017/0370264 | A1 * | 12/2017 | Meier | F01N 3/30 |

FOREIGN PATENT DOCUMENTS

| | | | |
|---|---|---|---|
| CN | 103670618 | A | 3/2014 |
| DE | 14 76 608 | A | 11/1969 |
| DE | 10 2010 044 102 | A1 | 5/2012 |
| EP | 0 640 752 | A1 | 3/1995 |
| EP | 2 711 516 | A2 | 3/2014 |
| GB | 2 459 176 | A | 10/2009 |
| WO | WO 96/23133 | A1 | 8/1996 |

OTHER PUBLICATIONS

International Search Report of PCT Application No. PCT/EP2018/064708, dated Jul. 11, 2018.
Search report for German Patent Application No. 18 729 935.9, dated Dec. 10, 2020.
Office Action for Chinese Patent Application No. 201880041151.8, dated Feb. 24, 2021.

* cited by examiner

EXHAUST PIPE, COMBUSTION ENGINE MACHINE, AND MOTOR VEHICLE

CROSS-REFERENCE TO RELATED APPLICATIONS

This application is a National Phase Application of PCT International Application No. PCT/EP2018/064708, International Filing Date Jun. 5, 2018, claiming priority of German Patent Application No. 10 2017 113 357.7, filed Jun. 19, 2017, which is hereby incorporated by reference.

FIELD OF THE INVENTION

The invention relates to an exhaust pipe for the exhaust tract of a combustion machine, the exhaust pipe having an inlet opening for an air connection. The invention further relates to a combustion machine having such an exhaust pipe, and a motor vehicle having such a combustion machine.

BACKGROUND OF THE INVENTION

The exhaust gases of internal combustion engines used for the drive of motor vehicles undergo complex aftertreatment in order to reduce pollutant emissions to a minimum. Numerous different exhaust gas aftertreatment devices are used to allow the various pollutants in the exhaust gas to be reduced in the most effective manner possible.

The use of particulate filters via which the particles, in particular soot particles, contained in the exhaust gas may be filtered out is widespread for the aftertreatment of exhaust gases produced by diesel engines. Such particulate filters must be continuously or discontinuously regenerated to prevent the deposited particles from impermissibly increasing the exhaust gas back pressure brought about by the particulate filters. This takes place by post-combustion or post-oxidation of the soot particles, which requires an appropriately high (ignition) temperature. The exhaust gas usually does not have such a high temperature, at least during operation of an internal combustion engine at relatively low rotational speeds and relatively low loads, which are present in particular in city traffic. In this case, the temperature of the exhaust gas must be appropriately increased, for which various measures are known. Alternatively or additionally, by use of an additive and/or a catalytic converter the temperature required for oxidation of the soot particles may be lowered to the extent that it may be achieved even during operation of an internal combustion engine at relatively low rotational speeds and loads.

In a diesel engine, it is often possible to reach a sufficiently high temperature for regenerating a particulate filter in a relatively simple manner by situating the particulate filter as close as possible to the engine, in conjunction with engine-internal measures that temporarily bring about an increase in the exhaust gas temperature while accepting reduced efficiency. In contrast, in a gasoline engine the problem may arise that for the most effective exhaust gas aftertreatment possible, a 3-way catalytic converter is to be situated close to the engine, with the particulate filter then only being situated downstream from it. In particular due to the limited installation space available in the engine compartment of a motor vehicle, it may be necessary to situate the particulate filter beneath the underbody. This arrangement may result in the exhaust gas that arrives at the particulate filter no longer being hot enough for regeneration of the particulate filter, despite a relatively high temperature which the exhaust gas has shown, due to engine-internal measures, when leaving the internal combustion engine. In this case it may be meaningful to once again increase the temperature of the exhaust gas in the particulate filter, which in this respect also has a catalytic effect, by post-oxidation of unburned hydrocarbons contained in the exhaust gas. To this end, air or oxygen contained in the air must be supplied to the exhaust gas, for which purpose an air connection may be integrated into an exhaust pipe of the exhaust tract upstream from the particulate filter.

For effective post-oxidation and thus an increase in the temperature of the exhaust gas, the air introduced into the exhaust gas must be mixed with the exhaust gas in the best possible manner.

U.S. Pat. No. 4,339,918 discloses a device for guiding exhaust gas, the device being provided for connection at the end of an exhaust tract of a combustion machine of a motor vehicle. The device includes a guide tube that widens in a first section relative to the provided throughflow direction for the exhaust gas. The tube tapers in a second section adjoining the first section, before the tube once again widens in a third (end) section. Multiple helically extending vanes arranged in a star shape are situated in the first and second sections of the tube. The aim is to achieve an acceleration of the exhaust gas flowing through the guide tube by means of these vanes, and in combination with the course of the diameter for the various sections of the guide tube. As a result, the exhaust gas is to be discharged in an improved manner from the combustion chambers of the internal combustion engine, to which the exhaust tract is connected, which in turn is intended to have a positive effect on the operating behavior of the internal combustion engine. In addition, it may be provided that the device has a further tube that surrounds the third section of the guide tube on the outer side, this tube delimiting an annular gap, which is open at both ends, via the outer side of the guide tube. When the motor vehicle is traveling, the aim is for the airflow passing through this annular gap to bring about an additional suction effect on the exhaust gas exiting the guide tube.

SUMMARY OF THE INVENTION

The object of the invention is to provide an exhaust pipe for the exhaust tract of a combustion machine, the exhaust pipe having an air connection that is used to mix air with exhaust gas that flows in the exhaust pipe, so that with a simple design and thus in a cost-effective manner, the best possible intermixing is achieved by means of the exhaust pipe.

This object is achieved by means of an exhaust pipe, a combustion machine having such an exhaust pipe and a motor vehicle having such a combustion machine are the subject matter of independent claims. Advantageous embodiments of the exhaust pipe according to the invention, the combustion machine according to the invention, and the motor vehicle according to the invention are the subject matter of the further claims and/or result from the following description of the invention.

According to the invention, an exhaust pipe for the exhaust tract of a combustion machine, having an inlet opening for an air connection, is characterized by an inner pipe section that is surrounded by an outer pipe section to form an annular channel, which at one (longitudinal axial) end is closed, and at the other (longitudinal axial) end is open toward the internal volume of the exhaust pipe, the inlet opening for the air connection being integrated into the outer pipe section. By means of such an exhaust pipe, advantageous mixing of air supplied via the air connection into exhaust gas flowing within the exhaust pipe may be achieved with a simple design, which may be attributed in particular to the complete introduction of the air in combination with the flow direction that is present along the longitudinal axis of the annular channel and the exhaust pipe. The good mixture of the air with the exhaust gas thus achieved may be important in particular when the exhaust tract branches into at least two, and in particular exactly two, tracts within a relatively short distance downstream from the exhaust pipe, (in each case) a particulate filter being integrated into one or more or all of the tracts. In this way, formation of uneven mixtures of exhaust gas and air in the tracts, and thus, in the particulate filter(s) integrated therein, may preferably be avoided.

It may preferably be provided that the open end of the annular channel, in comparison to the closed end, is situated downstream from a flow direction of the exhaust gas that is provided for use of the exhaust pipe. As a result, it is possible for the air flowing in the annular channel in the direction of the open end to have basically the same flow direction as the exhaust gas flowing through the exhaust pipe, so that turbulence in introducing the air stream into the exhaust gas stream, which increases the exhaust gas pressure, may be kept low.

Alternatively, it may also be provided that the open end of the annular channel, in comparison to the closed end, is situated upstream from the provided throughflow direction, as the result of which it may optionally be possible to achieve a further improvement in intermixing directly in the area where the air stream is introduced into the exhaust gas stream.

An exhaust pipe according to the invention that is characterized by a particularly simple structural design may include a first pipe section and a second pipe section, wherein an end section of the first pipe section in the longitudinal axial direction, preferably with a parallel or coaxial orientation of their longitudinal axes, is inserted into an end section of the second pipe section so that the two end sections of the pipe sections form the inner pipe section and the outer pipe section of the exhaust pipe. In this way, an exhaust pipe according to the invention may be formed essentially from two pipe sections having a simple design. At least one or both of the pipe sections, which preferably have a circular ring-shaped cross section, may in particular also have a constant inner and/or outer diameter over the longitudinal course.

According to one preferred refinement of such an exhaust pipe according to the invention, it may be provided that the closed end of the annular channel is formed by means of a radially inwardly extending end edge of the second pipe section. On the inner side, this radially inwardly extending end edge of the second pipe section may contact the outer side of the first pipe section, directly or with an additional element such as a sealing element in between. Such an exhaust pipe according to the invention may be manufactured particularly easily, and thus cost-effectively, when the radially inwardly extending end edge is designed as a (plastically and thus permanently) deformed end piece of the second pipe section. Accordingly, the radially inwardly extending end edge of the second pipe section may be easily manufactured by bending an end piece of the second pipe section radially inwardly, which may take place before or after the two pipe sections have been inserted into one another.

The invention further relates to a method for manufacturing such an exhaust pipe according to the invention, in which the pipe sections are inserted into one another in such a way that the end sections, which are then preferably oriented coaxially with respect to one another, form the inner pipe section and the outer pipe section. Within the scope of the method according to the invention, the annular channel situated between the inner pipe section and the outer pipe section is closed at the exterior end of the second pipe section, which is preferably achievable by prior or subsequent bending of an appropriate end piece of the second pipe section. Within the scope of such a method, it is also possible to introduce the inlet opening for the air connection in the area of the end section of the second pipe section delimiting the annular channel, which likewise may take place before or after the assembly with the first pipe section. In addition, a connecting piece for the air connection may be connected to the second pipe section in the area of the inlet opening, which may take place in a form-fit or integrally joined manner, for example by welding or soldering.

According to one preferred embodiment of an exhaust pipe according to the invention, it may be provided that at least one flow guiding element for generating a swirl flow of the exhaust gas is situated within the inner pipe section. Intermixing of the exhaust gas with the introduced air may be positively influenced via such a swirl flow of the exhaust gas. In addition, it is possible to generate a negative pressure within the annular channel, so that introduction of air via the air connection may be assisted.

Such an exhaust pipe according to the invention may be designed to be advantageously manufacturable when, as is preferably provided, the flow guiding element is designed in the form of a (plastically and thus permanently) deformed pipe casing section. The pipe casing section may particularly preferably have a triangular shape, wherein a forming edge of the flow guiding element extends helically with respect to the longitudinal axis of the inner pipe section, from a longitudinal opening that is introduced into the pipe casing and that is oriented in the longitudinal direction of the inner pipe section (in particular parallel to the longitudinal axis). It may also be preferably provided that the longitudinal opening runs out at an end edge of the inner pipe section, so that the forming edge likewise extends to this end edge. In this way, it is also possible to dispense with the introduction, which in principle is likewise possible, of a second longitudinal opening that extends in the circumferential direction and merges into the first longitudinal opening. The longitudinal opening(s) may preferably be subsequently introduced in the form of separation cuts into the pipe casing.

Manufacturing such a flow guiding element is therefore relatively simple. For this purpose, it is necessary only to introduce the longitudinal opening(s) into the inner pipe section, and to subsequently form the flow guiding element by bending an appropriate triangular pipe casing section along the forming edge. The invention further relates to a corresponding method for manufacturing such an exhaust pipe according to the invention.

According to one preferred refinement of an exhaust pipe according to the invention having a flow guiding element, it may be provided that the inner pipe section adjoining one side of the flow guiding element preferably situated downstream (with respect to the provided flow direction of the exhaust gas) forms a through opening or pipe casing opening. A portion of the air that is supplied to the annular channel via the inlet opening for the air connection may advantageously enter the exhaust gas stream through this through opening in an orientation that is angled with respect to the section of the longitudinal axis of the exhaust pipe at that location, wherein this air stream may likewise form a swirl flow due to the adjoining arrangement of the flow guiding element. Particularly advantageous mixing between the air and the exhaust gas may be achieved in this way.

A combustion machine according to the invention includes at least an internal combustion engine and an exhaust tract for discharging exhaust gas from the internal combustion engine, an air connection for introducing air into the exhaust tract also being integrated into the exhaust tract. The exhaust tract also includes at least one exhaust pipe according to the invention.

A motor vehicle according to the invention includes at least a combustion machine according to the invention. The motor vehicle may in particular be a wheeled motor vehicle, preferably a passenger vehicle or truck. The internal combustion engine of the combustion machine may in particular be provided for (directly or indirectly) providing the drive power for the motor vehicle.

The exhaust pipe of a combustion machine according to the invention is used for mixing air as needed with exhaust gas that is conducted through the exhaust tract or through the exhaust pipe, this air preferably being used for regeneration of a particulate filter that is integrated into the exhaust tract downstream from the air connection. Regeneration of the particulate filter using the air that is mixed with the exhaust gas may in particular therefore be necessary or meaningful due to the fact that an exhaust gas catalytic converter, in particular a 3-way catalytic converter, is integrated into the exhaust tract upstream from the air connection, resulting in the particulate filter being a relatively large distance from the internal combustion engine, which in turn results in the exhaust gas already having a relatively low temperature when it reaches the particulate filter, in particular also due to the flow through the exhaust gas catalytic converter that has previously taken place. Such an arrangement of these types of exhaust gas aftertreatment devices may be meaningful in particular for a spark ignition internal combustion engine, in particular for an internal combustion engine that is operated according to the Otto principle (gasoline engine). In particular, it may therefore also be provided that the particulate filter is situated beneath an underbody of the motor vehicle. An "underbody" is understood to mean the bottom side of the body of a motor vehicle which, starting from the rear end of an engine compartment that accommodates the internal combustion engine, extends in the direction of the rear end of the motor vehicle.

The air provided for mixture with the exhaust gas may in particular be withdrawn from a fresh gas tract of the combustion machine, for which purpose a connecting line is provided between the fresh gas tract and the air connection for the exhaust pipe. The connecting line may in particular diverge from the fresh gas tract downstream from an air filter in order to supply filtered air to the exhaust tract and optionally also to a conveying device that is preferably integrated into the connecting line and provided for conveying air from the fresh gas tract to the air connection of the exhaust pipe.

The indefinite articles "a" and "an," in particular in the claims and in the description which provides a general explanation of the claims, are understood as such, and not as numerals. Accordingly, specific components are to be understood in such a way that they may be present at least once, and may be present multiple times.

BRIEF DESCRIPTION OF THE DRAWINGS

The present invention is explained in greater detail below with reference to exemplary embodiments that are illustrated in the drawings, which show the following.

DETAILED DESCRIPTION OF THE INVENTION

Figure 1:
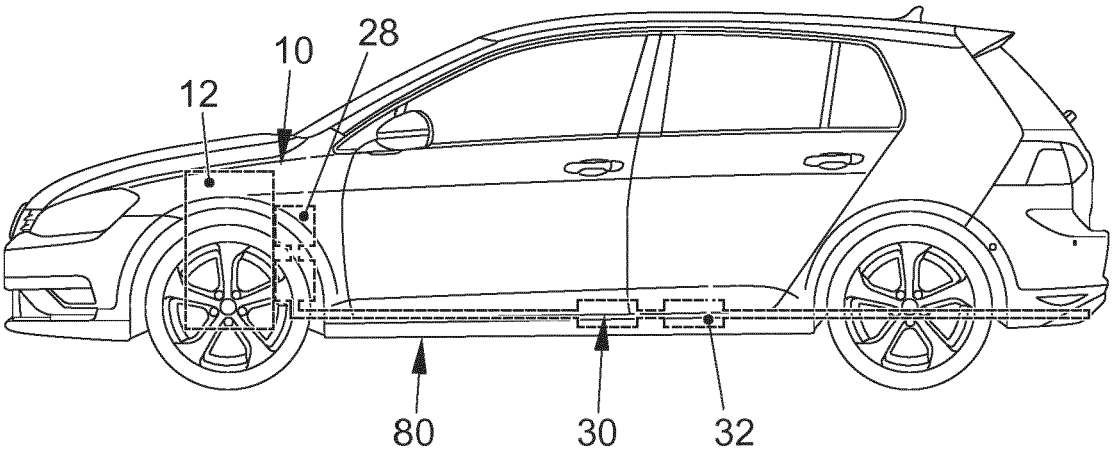
FIG. 1: shows a simplified illustration of a motor vehicle according to the invention.

FIG. 1 shows a motor vehicle according to the invention with a combustion machine 10 according to the invention.

Figure 2:
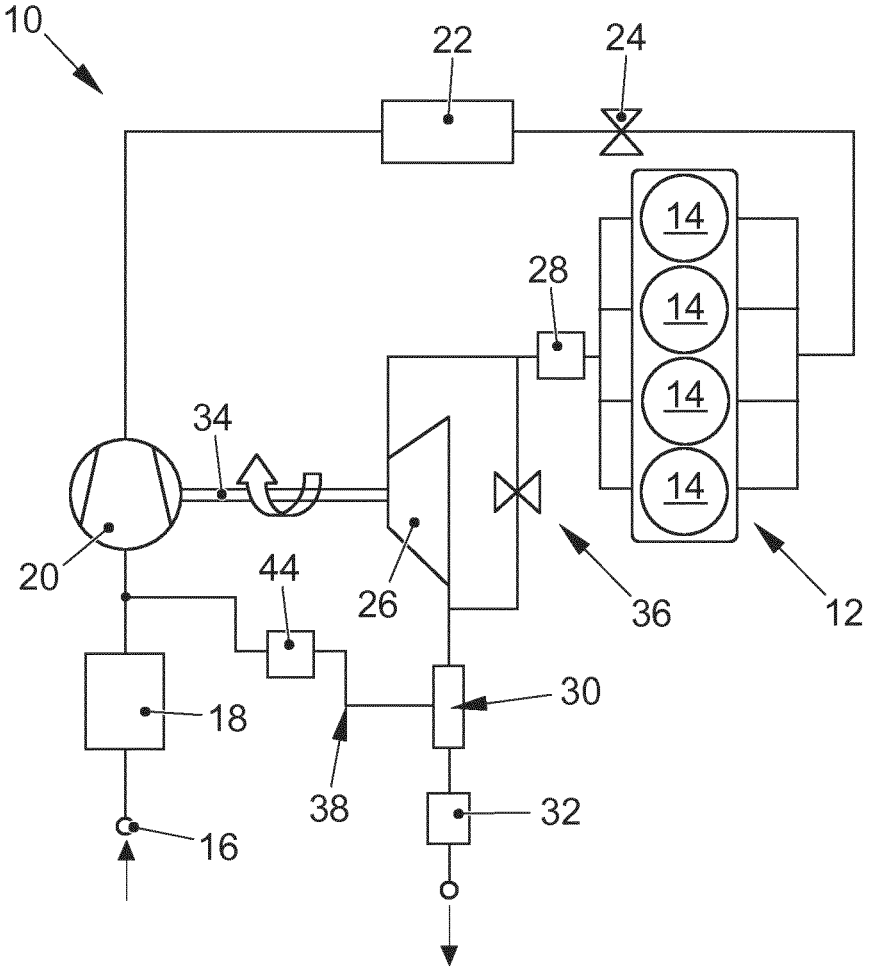
FIG. 2: shows a schematic illustration of a combustion machine according to the invention.

The combustion machine 10 according to FIG. 2 may include an internal combustion engine 12, in particular a gasoline engine, that forms a plurality of cylinders 14. The cylinders 14, together with pistons that are guided up and down and a cylinder head (not illustrated in either case), delimit combustion chambers in which fresh gas (primarily air) together with fuel is combusted, as the result of which the pistons are cyclically moved up and down. This movement of the pistons is transmitted in a known manner to a crankshaft, not illustrated, which is thus rotationally driven.

The fresh gas is supplied to the internal combustion engine 12 via a fresh gas tract, and for this purpose is drawn in from the surroundings via an intake opening 16, purified in an air filter 18, and subsequently led into a compressor 20 which is part of an exhaust gas turbocharger. The fresh gas is compressed by means of the compressor 20, subsequently cooled in a charge air cooler 22, and with optional control by means of a throttle valve 24, supplied to the combustion chambers.

The drive of the compressor 20 is provided by means of a turbine 26 that is integrated into an exhaust tract of the combustion machine and is likewise part of the exhaust gas turbocharger. Exhaust gas that is produced during the combustion of the fuel-fresh gas mixture in the combustion chambers of the internal combustion engine 12 is discharged from the internal combustion engine 12 via the exhaust tract, and initially flows through an exhaust gas catalytic converter 28 in the form of a 3-way catalytic converter, then through the turbine 26, and then through an exhaust pipe 30 according to the invention and into a particulate filter 32, and after flowing through a muffler (not illustrated) the exhaust gas is released to the environment. Due to the arrangement of the exhaust gas catalytic converter 28 close to the engine and due to the arrangement downstream from the turbine 26, on account of the limited installation space that is present in an engine compartment of the motor vehicle, it may be necessary to situate the particulate filter 32 beneath an underbody 80 of the motor vehicle (see FIG. 1).

Flow through the turbine 26 results, in a known manner, in a rotating drive of a turbine impeller, which in turn is rotatably fixedly connected to a compressor impeller of the compressor 20 via a shaft 34. The rotating drive of the turbine impeller is thus transmitted to the compressor impeller. To limit the pressure buildup in the fresh gas tract during operation of the internal combustion engine 12 at high rotational speeds and high loads, the turbine 26 may be bypassed in a known manner by means of a so-called wastegate 36. Additionally or alternatively, a turbine with variable turbine geometry (VTG) may be used.

The particulate filter 32 is used to filter particles, in particular soot particles, from the exhaust gas. This may result in the particulate filter 32 becoming clogged in the course of operation, which requires regeneration of the particulate filter 32 to prevent the exhaust gas back pressure created by the particulate filter 32 from becoming impermissibly high. For such regeneration, engine-internal measures are implemented during operation of the internal combustion engine 12, on the one hand to set relatively high exhaust gas temperatures, and on the other hand to increase the proportion of unburned hydrocarbons in the exhaust gas. The aim is to oxidize (post-combust) unburned hydrocarbons in combination with oxygen that is supplied to the exhaust gas shortly before reaching the particulate filter 32 in order to increase the temperature of the exhaust gas in the particulate filter 32, which has already cooled fairly substantially due to the relatively large distance of the particulate filter 32 from the internal combustion engine 12, to the extent that the desired oxidation of the soot particles in the particulate filter 32, and thus the regeneration of the particulate filter 32, can take place.

The oxygen provided for this purpose, as a component of air, is supplied to the exhaust gas via an air connection 42 that is integrated into an exhaust pipe 30 according to the invention. The air is led over a connecting line 38, which diverges from the fresh gas tract downstream from the air filter 18, and via the air connection 42 opens into an inlet opening 40 in the exhaust pipe 30. Conveying of this air is assisted or brought about by means of a conveying device 44. The exhaust pipe 30 represents a section of the exhaust tract that is situated a relatively short distance upstream from the particulate filter 32.

Figure 3:
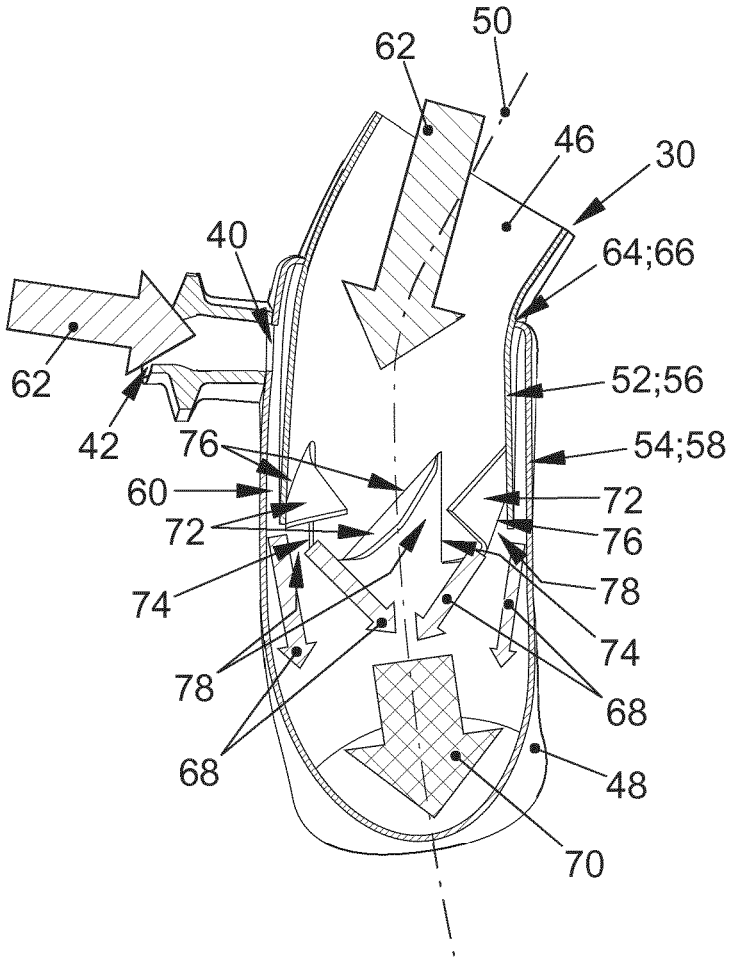
FIG. 3: shows a partial longitudinal section of an exhaust pipe according to the invention.

Such an exhaust pipe 30 may have the structural design illustrated in FIG. 3. This exhaust pipe 30 according to FIG. 3 includes a first pipe section 46, which has a constant inner and outer diameter over the longitudinal extension, and a second pipe section 48, which likewise has a constant inner and outer diameter over the longitudinal extension. The two pipe sections 46, 48 have a curved design. An end section 52 of the first pipe section 46, in the direction along its longitudinal axis 50 and in a coaxial configuration, is inserted into an end section 54 of the second pipe section 48. This end section 52 of the first pipe section 46 represents an inner pipe section 56, and the end section 54 of the second pipe section 48 represents an outer pipe section 58, of the exhaust pipe 30. An annular channel 60 is formed between the two end sections 52, 54 or pipe sections 56, 58, since the inner diameter of the second pipe section 48 is larger, by a defined extent, than the outer diameter of the first pipe section 46.

This annular channel 60 is formed on the end situated upstream from the (flow) direction provided for the flow of the exhaust gas 62, and is thus closed with respect to the surroundings. For this purpose, it is provided that a bent end piece 64 of the second pipe section 48 forms a radially inwardly extending end edge 66, which on the inner side contacts the outer side of the first pipe section 46 and is sealingly connected, for example soldered, welded, or adhesively bonded, thereto. In contrast, the annular channel 60 is open on the end situated downstream from the flow direction of the exhaust gas 62, and thus within the exhaust pipe 30, as the result of which air 68 that is supplied to the exhaust pipe 30 via the air connection 42 that is connected to the inlet opening 40 may be initially completely distributed within the annular channel 60, and from there may flow into the section of the second pipe section 48 downstream from the annular channel 60 with a flow direction that basically corresponds to the flow direction of the exhaust gas 62, and at that location the air 68 is mixed with the exhaust gas 62 that has flowed from the first pipe section 46 into the second pipe section 48, and may be supplied to the particulate filter 32 as an exhaust gas-air mixture 70.

To achieve particularly advantageous intermixing of the air 68 with the exhaust gas 62, the inner pipe section 56 on the end situated downstream from the flow direction of the exhaust gas 62 forms a plurality of flow guiding elements 72 in the form of baffle plates oriented obliquely with respect to the longitudinal axis 50 of the exhaust pipe 30. These flow guiding elements 74 bring about swirl of the exhaust gas stream that flows through or around them, thus improving the mixing with the air 68 that is supplied on the edge side.

The flow guiding elements 72 are distributed over the circumference of the inner pipe section 56 with an identical orientation and a uniform division. These flow guiding elements have been produced by introducing longitudinal openings 74, extending in the longitudinal axial direction with a uniform division and a defined length, in the form of separation cuts into the pipe casing formed by the end section 52 of the first pipe section 46. In each case a triangular section of this pipe casing has then been bent inwardly along a forming edge 76 that extends obliquely or helically about the longitudinal axis 50, wherein this forming edge 76, starting from the closed end of the associated longitudinal opening 74, extends to the end of the inner pipe section 56 or the end section 52 of the first pipe section 46 at which the longitudinal opening 74 runs out.

Due to this type of design of the flow guiding elements 72, through openings 78 are at the same time formed in the pipe casing of the inner pipe section 56, in the slipstream of the flow guiding elements (with respect to the flow of the exhaust gas 62). As a result of these through openings 78, the air supplied to the exhaust pipe 30 may also partially flow into the stream of the exhaust gas 62 in directions extending obliquely with respect to that section of the longitudinal axis 50, and with swirl that is produced by the flow guiding elements 72, which likewise has a positive effect on the intermixing of the air 68 with the exhaust gas 62.

LIST OF REFERENCE NUMERALS

10 combustion machine
12 internal combustion engine
14 cylinder
16 intake opening
18 air filter
20 compressor
22 charge air cooler
24 throttle valve
26 turbine
28 exhaust gas catalytic converter
30 exhaust pipe
32 particulate filter
34 shaft
36 wastegate
38 connecting line
40 inlet opening in the exhaust pipe
42 air connection
44 conveying device
46 first pipe section
48 second pipe section
50 longitudinal axis of the first pipe section/second pipe section/exhaust pipe
52 end section of the first pipe section
54 end section of the second pipe section
56 inner pipe section
58 outer pipe section
60 annular channel
62 exhaust gas
64 end piece of the second pipe section

66 end edge of the second pipe section
68 air
70 exhaust gas-air mixture
72 flow guiding element
74 longitudinal opening
76 forming edge
78 through opening
80 underbody of the motor vehicle

The invention claimed is:

1. An exhaust pipe for the exhaust tract of an internal combustion engine, the exhaust pipe having:

an inlet opening configured for attachment to an air connection, and an inner pipe section that is surrounded by an outer pipe section to form an annular channel that is closed at one end and at the other end is open toward an inner volume of the exhaust pipe, wherein the inlet opening for the air connection is integrated into the outer pipe section, at least one flow guiding element for generating a swirl flow of the exhaust gas situated within the inner pipe section, wherein the at least one flow guiding element is in the form of a baffle plate that is oriented obliquely with respect to a longitudinal axis of the exhaust pipe, wherein the at least one flow guiding element is designed in the form of a deformed section of a pipe casing of the inner pipe section, wherein the pipe casing section has a triangular shape, and wherein a forming edge of the at least one flow guiding element extends helically with respect to a longitudinal axis of the inner pipe section, from a longitudinal opening that is introduced into the pipe casing and extends in a longitudinal direction of the inner pipe section.

2. The exhaust pipe according to claim 1, further comprising a first pipe section and a second pipe section, wherein an end section of the first pipe section is inserted into an end section of the second pipe section so that the two end sections form the inner pipe section and the outer pipe section.

3. The exhaust pipe according to claim 2, wherein the closed end of the annular channel is formed by a radially inwardly extending end edge of the second pipe section.

4. The exhaust pipe according to claim 3, wherein the radially inwardly extending end edge is designed as a deformed end piece of the second pipe section by plastic deformation of said end piece.

5. The exhaust pipe according to claim 1, wherein the inner pipe section adjoining one side of the at least one flow guiding element forms a through opening, wherein the inner pipe section is situated downstream with respect to a flow direction of the exhaust gas of the flow guiding element.

6. A combustion machine having the internal combustion engine and the exhaust tract for discharging exhaust gas from the internal combustion engine, wherein the air connection for introducing air into the exhaust tract is integrated into the exhaust tract, wherein the exhaust tract includes an exhaust pipe according to claim 1.

7. The combustion machine according to claim 6, further comprising a particulate filter integrated into the exhaust tract downstream from the air connection.

8. The combustion machine according to claim 6, further comprising an exhaust gas catalytic converter integrated into the exhaust tract upstream from the air connection.

9. The combustion machine according to claim 6, wherein the internal combustion engine has a spark ignition design.

10. A motor vehicle having a combustion machine according to claim 6.

11. The motor vehicle according to claim 10, further comprising a particulate filter situated beneath an underbody of the motor vehicle.

* * * * *